US005667406A

United States Patent [19]

Tabata et al.

[11] Patent Number: 5,667,406

[45] Date of Patent: Sep. 16, 1997

[54] WATERPROOF SEAL FOR CONNECTOR AND METHOD FOR FORMING SAME

[75] Inventors: Masaaki Tabata; Hiroyuki Hayashi, both of Yokkaichi, Japan

[73] Assignee: Sumitomo Wiring Systems, Ltd., Mie, Japan

[21] Appl. No.: 500,244

[22] Filed: Jul. 10, 1995

[30] Foreign Application Priority Data

Jul. 27, 1994 [JP] Japan ..... 6-195858
Aug. 22, 1994 [JP] Japan ..... 6-221031

[51] Int. Cl.[6] ..... H01R 13/40

[52] U.S. Cl. ..... 439/587

[58] Field of Search ..... 439/274, 275, 439/278, 279, 587, 589, 686, 690, 752

[56] References Cited

U.S. PATENT DOCUMENTS 4,643,506 2/1987 Kobler .
5,147,222 9/1992 Hotea et al. .

FOREIGN PATENT DOCUMENTS 57-145287 9/1982 Japan .
58-37676 3/1983 Japan .
63-3074 1/1988 Japan .
4-8271 1/1992 Japan .
2-249-884 5/1992 United Kingdom .

*Primary Examiner*—Khiem Nguyen
*Attorney, Agent, or Firm*—Oliff & Berridge

[57] ABSTRACT

A waterproof seal has at its rear portion a wire embracing portion for embracing an outer periphery of a wire. The wire embracing portion includes a flexible tubular portion having a reduced thickness, and a thickened tubular portion extending from the flexible tubular portion. Because buckling strength is enhanced by the thickened tubular portion, the wire can be smoothly passed through the waterproof seal from the distal end of the wire embracing portion without buckling the wire embracing portion and hence without closing an insertion hole. The flexible tubular portion is easily bent about an inner peripheral lip in accordance with the movement of the wire, thereby preventing the bending force from acting on and deforming the main waterproof portion. Alternatively, a groove is formed in one end surface of a rubber plug body, and is disposed around an outer periphery of a proximal end of a tubular portion connected to the rubber plug body. Tension is alleviated between the proximal end of the tubular portion and the rubber plug body in accordance with the deformation of the groove.

18 Claims, 4 Drawing Sheets

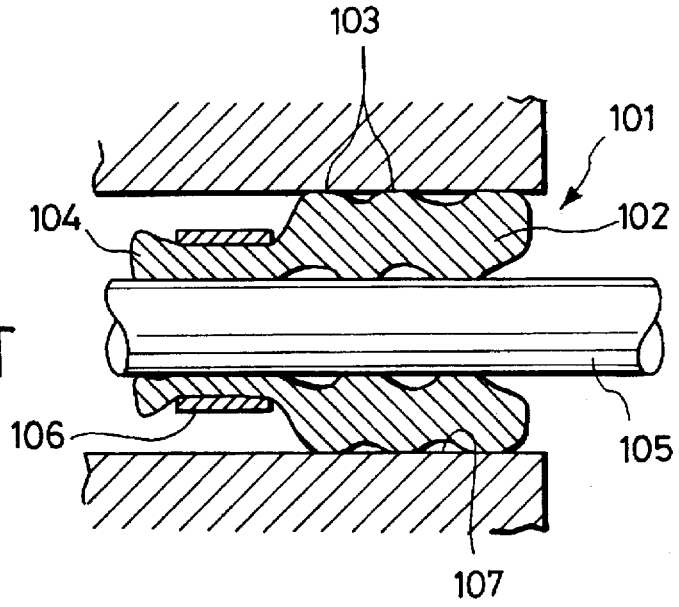
FIG. 1
PRIOR ART
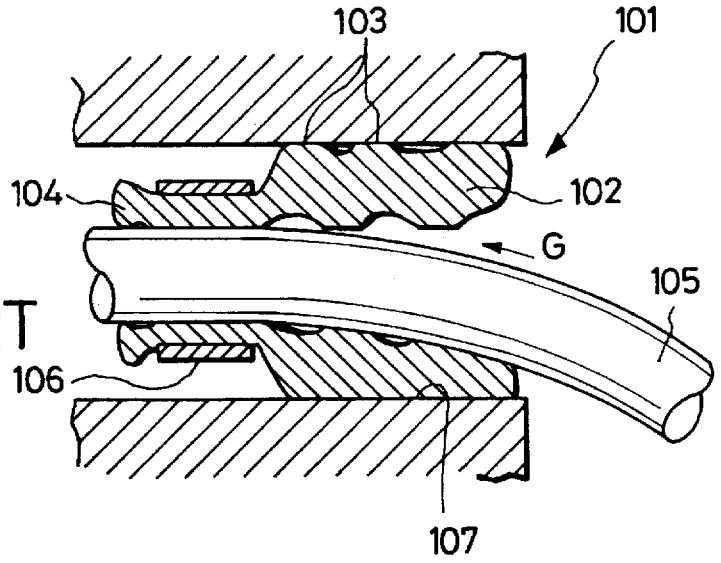
FIG. 2
PRIOR ART
FIG. 3
PRIOR ART
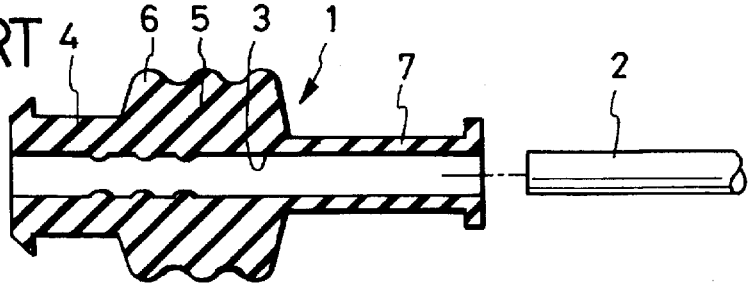

WATERPROOF SEAL FOR CONNECTOR AND METHOD FOR FORMING SAME

BACKGROUND OF THE INVENTION

This invention relates to a waterproof seal for a connector that forms a watertight seal between a wire and a cavity in a connector housing.

In a waterproof connector, a rubber plug is used for preventing water from intruding into the interior of the connector through an insertion-side open end of a cavity for receiving a metal terminal. One conventional rubber plug is shown in FIG. 1. A rubber plug 101 includes a tubular rubber plug body 102 having lips 103 formed on an outer periphery thereof, and a tubular clamping portion 104 extending from one end of the rubber plug body 102. A wire 105 passes through both the rubber plug body 102 and the clampi/ng portion 104 in a closely-fitted manner. In this condition, a barrel 106 of a metal terminal is clamped to the clamping portion 104, thereby fixedly securing the rubber plug 101 to the metal terminal. When the rubber plug 101 is inserted, together with the metal terminal, into a cavity 107, the lips 103 on the outer periphery of the rubber plug body 102 are elastically deformed by the inner periphery of the cavity 107, and are held in intimate contact with the inner periphery, thereby preventing water from intruding into the area of contact between the inner periphery of the cavity 107 and the outer periphery of the rubber plug 101.

The rubber plug 101 is fitted in the cavity 107. When a bending force acts on the wire 105 extending outwardly from the open end of the cavity 107, the open end of the rubber plug 101 is deformed by a compressive force, applied from the wire 105, at an inner side of the bent portion, so that a gap G is formed between the wire 105 and the rubber plug 101 at an outer side of the bent portion, as shown in FIG. 2. When the gap G thus develops between the wire 105 and the rubber plug 101, water passes through the gap and reaches an inner portion of the cavity 107 where the metal terminal is received.

To deal with this problem, it has been proposed to provide a tubular portion extending from the outer open end of the rubber plug body, in which case the wire is passed through the tubular portion in closely-fitted relation thereto, so that a gap will not be formed at an outer side of a bent portion upon application of a bending force on the wire.

However, when the tubular portion is formed in this manner, a tension is applied from the wire to the rubber plug body through the tubular portion so that the rubber plug body may be elastically deformed at the outer side of the bent portion, thus forming a gap between the rubber plug body and the inner periphery of the cavity. Therefore, in this case, also, the waterproof function is adversely affected.

One example of the waterproof connector seal described above is shown in FIG. 3. A waterproof seal 1 includes a tubular body having a central bore 3 for passing a wire 2 therethrough, and has a mounting portion 4 adapted to be fixedly secured to an outer periphery of a sheath of the wire 2 at one of its ends by an insulation barrel of a metal terminal clamped to the mounting portion 4. A main waterproof sealing portion 5 having lips 6 formed on its outer peripheral surface is adapted to be fitted in a watertight manner into a cavity in a connector housing. Also provided is a thin, elongate wire-embracing portion 7 for embracing the outer periphery of the wire 2. The waterproof seal 1 is fixedly secured to the end portion of the wire 2, and is fitted in a cavity in the connector housing. If the wire 2 is bent in a head-nodding manner, the wire embracing portion 7, while kept in intimate contact with the wire 2, is deformed in accordance with the head-nodding motion to thereby prevent a bending force from acting on the main waterproof portion 5, thus preventing the main waterproof portion 5 from being deformed, so that a waterproof effect is maintained.

For passing the wire 2 through the waterproof seal 1 in order that the waterproof seal 1 can be fixedly secured to the end portion of the wire 2, the waterproof seal 1 is set in a jig, or is held by the hand, and then the wire 2 is inserted into the wire embracing portion 7 through its distal end. However, the wire embracing portion 7 of the waterproof seal 1 is thin over the entire length thereof. Therefore, if the front end of the wire 2 is caught by the distal end of the wire embracing portion 7 when the wire 2 is to be inserted into the wire embracing portion 7, the wire embracing portion 7 can easily buckle and deform so as to close the insertion port. Thus, a problem exists in that the insertion of the wire 2 is difficult.

Further, because the wire embracing portion 7 is thin throughout its length, it can be easily bent along any portion of its length. Accordingly, if the wire embracing portion 7 is bent in the vicinity of its distal end, a bending span is so short that the bending angle is large. As a result, the distal end of the wire embracing portion 7 is spaced apart from the wire 2, thereby forming a gap therebetween.

SUMMARY OF THE INVENTION

It is therefore an object of this invention to provide a waterproof seal for a connector in which a wire embracing portion not only performs its original function to enhance a waterproof effect of a main waterproof portion, but also enables a simple wire inserting operation and effectively prevents a gap from being formed between the wire embracing portion and a wire.

According to a first aspect of the present invention, there is provided a waterproof seal for a sealing a cavity of a connector. The waterproof seal includes a main waterproof portion having an outer periphery that contacts an inner peripheral surface of the cavity, and a wire embracing portion formed integrally with and extending from the main waterproof portion for embracing the outer periphery of the wire, an outer diameter of the wire embracing portion being smaller than an outer diameter of the main waterproof portion. The wire embracing portion includes a flexible tubular portion having a reduced thickness extending from the main waterproof portion, and a thickened tubular portion extends from a distal end of the flexible tubular portion, the thickened tubular portion being bulged radially outwardly over a predetermined length.

Further, a tapering surface may be formed on an outer periphery of the thickened tubular portion, and may taper towards a distal end of the wire embracing portion.

Furthermore, the waterproof seal may have at its inner peripheral surface a lip that is formed in the vicinity of a boundary between the main waterproof portion and the wire embracing portion. The lip is held in intimate contact with the wire while a gap is formed between the inner periphery of the flexible tubular portion and the wire.

According to a second aspect of the present invention, a rubber plug for a waterproof connector comprises a rubber plug body that has a tubular construction for passing a wire therethrough, and is adapted to be held in intimate contact with an inner periphery of a cavity for receiving a metal terminal. A tubular portion extending from one end surface of the rubber plug body cooperates with an annular groove formed in the end surface of the rubber plug body, the annular groove being disposed around an outer periphery of a proximal end of the tubular portion.

Furthermore, the groove may be defined by a curved surface that is smoothly continuous with the outer periphery of the proximal end of the tubular portion.

According to the first aspect of the present invention, the outwardly-bulging, thick tubular portion is provided at the distal end portion of the wire embracing portion over a predetermined length to increase its buckling strength. Therefore, even if the front end of the wire is caught by the distal end of the wire embracing portion when the wire is to be inserted into the waterproof seal, the wire embracing portion will not buckle, so that an insertion hole will not be closed. By further inserting the wire, the wire can be easily passed through the waterproof seal. The waterproof seal is mounted on the wire, and then is fitted into the cavity in the connector housing, and thereafter even if a bending force acts on the wire, the flexible tubular portion of the wire embracing portion remote from the distal end thereof is easily bent in accordance with the movement of the wire, thereby preventing the bending force from acting on the main waterproof portion, thus preventing the deformation of the main waterproof portion. This enhances the waterproof effect. The wire embracing portion is bent over a long span, that is, generally over its entire length, so that the angle of bending of this portion is kept to a small angle. This prevents the distal end of the wire embracing portion from being separated from the wire.

Therefore, the wire embracing portion performs its original function of enhancing the waterproof effect of the main waterproof portion, and also the wire can be easily passed through the waterproof seal. Additionally, the wire embracing portion can be bent over a long span, so that the bending angle is kept to a small angle. Therefore, an advantage is achieved because the distal end of the wire embracing portion will not be opened, so that a gap will not be formed between this distal end and the wire.

Furthermore, during high-pressure cleaning, the structure of the wire embracing portion causes water to flow to its outer periphery along a tapered surface, thereby preventing the water from intruding into the area of contact between the inner periphery of the wire embracing portion and the outer periphery of the wire, thus preventing the water from intruding into the waterproof seal.

Furthermore, when a bending force acts on the wire, the flexible tubular portion of the wire embracing portion is bent about the lip in accordance with the movement of the wire, with the lip kept in intimate contact with the wire. In this case, the provision of the gap between the inner periphery of the flexible tubular portion and the wire makes the bending of the flexible tubular portion easier. Moreover, because the lip is provided in the vicinity of the boundary between the main waterproof portion and the wire embracing portion, the flexible tubular portion can be bent at its proximal end, so that the bending space is maintained. Furthermore, the gap which is formed between the inner periphery of the flexible tubular portion and the wire, reduces the frictional resistance to the passage of the wire through the flexible tubular portion. Therefore, the insertion of the wire can be effected more easily.

According to the second aspect of the invention, when the tubular portion is bent and deformed by a bending force acting on the wire, a tension, produced between the proximal end of the tubular portion and the rubber plug body in accordance with the bending of the tubular portion, is alleviated and absorbed by deformation of the groove. Therefore, even when the tubular portion is bent and deformed, the rubber plug body will not be pulled by the tubular portion, and hence will not move out of contact with the inner periphery of the cavity at an outer side of the bent portion, thereby advantageously performing a positive sealing function.

Moreover, the curved surface defining the groove is smoothly continuous with the proximal end of the tubular portion. Therefore bending stresses, developing at the proximal end, will not be locally concentrated, but are distributed. Therefore, separation of the tubular portion from the rubber plug body due to local concentration of the stresses is prevented.

These and other advantages are described in or apparent from the following detailed description of preferred embodiments.

BRIEF DESCRIPTION OF THE DRAWINGS

Preferred embodiments of the invention are described in detail with reference to the following drawings, in which:

FIG. 1 is a cross-sectional view showing a condition in which a conventional rubber plug is mounted in a cavity;

FIG. 2 is a cross-sectional view showing a condition in which a wire is bent in the conventional construction;

FIG. 3 is a cross-sectional view of a conventional waterproof seal;

DETAILED DESCRIPTION OF PREFERRED EMBODIMENTS

A first preferred embodiment of the present invention will now be described with reference to FIGS. 4 to 7.

Figure 4:
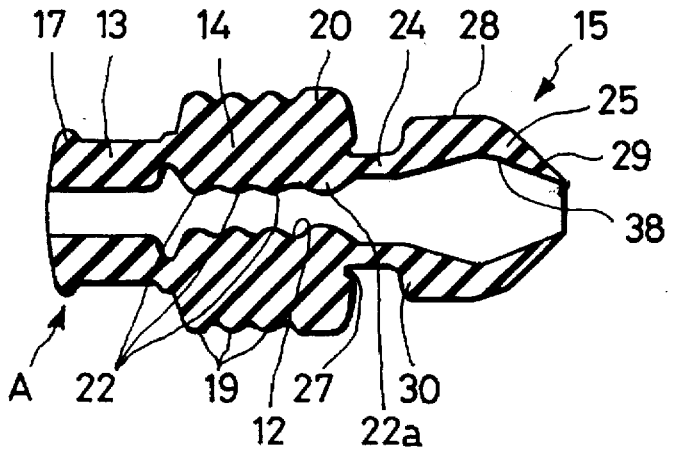
FIG. 4 is a cross-sectional view of one preferred embodiment of the present invention.

A waterproof seal A of this embodiment is made of elastic synthetic rubber, and includes a tubular body having a central bore 12 for passing a wire 1 therethrough, as shown in FIG. 4. The waterproof seal A has a mounting portion 13, a main waterproof portion 14, and a wire embracing portion 15 that are arranged in this order as viewed from a front end 100 of the waterproof seal.

The wire 11 is substantially snugly fitted in the inner periphery of the mounting portion 13, and a retaining flange 17 is formed on a distal end of the mounting portion 13 at an outer periphery thereof. An end portion of a sheath 11*a* of the wire 11 is passed through the inner periphery of the mounting portion 13, and then an insulation barrel 42 of a metal terminal 41 (shown in phantom in FIGS. 6 and 7) is clamped to the outer periphery of the mounting portion 13. Thus, the mounting portion 13 is fixedly secured to the end portion of the sheath 11*a* of the wire 11 and also to the metal terminal 41. Also, the insulation barrel 42 is retained by the retaining flange 17, so that the mounting portion 13 is prevented from being disengaged from the metal terminal 41.

The main waterproof portion 14 is provided such that it can be snugly fitted in a cavity 46 (shown in FIGS. 6 and 7) in a connector housing 45. Three outer peripheral lips 19 are formed on the outer peripheral surface of the main waterproof portion 14, and are spaced from one another along its length. Each outer peripheral lip 19 is in the form of an annular projection, and each lip 19 in its uncompressed condition has an outer diameter slightly larger than the inner diameter of the cavity 46. A retaining portion 20 is formed on the outer periphery of the main waterproof portion 14 at its a rear end. The retaining portion 20 is in the form of an annular projection that radially extends more outwardly than the outer peripheral lip 19, and is wider than the lip 19. The retaining portion 20 is retainingly engageable with an edge of an insertion port 47 of the cavity 46.

Four inner peripheral lips 22 each in the form of an annular projection are formed on the inner periphery of the main waterproof portion 14 (through which the wire 11 is adapted to be passed). The lips 22 are disposed in registry with the outer peripheral lips 19 and the retaining portion 20, respectively. The inner diameter of each inner peripheral lip 22 in its uncompressed condition is slightly smaller than the outer diameter of the wire 11. The rearmost one **22*a* of the four inner peripheral lips serves as a fulcrum for the bending of the wire embracing portion 15, as will hereinafter more fully be described. This rearmost lip 22*a* is wider than the other three inner peripheral lips 22**.

The wire embracing portion 15 includes a flexible tubular portion 24 extending from the main waterproof portion 14, and a thick tubular portion 25 extending from 10 a rear end of the flexible tubular portion 24. The flexible tubular portion 24 is reduced in its outer diameter over a short portion (that is, about ⅕) of the entire length of the wire embracing portion 15, and has an inner diameter larger than the outer diameter of the wire 11, so that the flexible tubular portion 24 has a thin peripheral wall. A circular notch groove 27 is formed in the rear end surface of the main waterproof portion 14 from which the flexible tubular portion 24 extends, the circular notch groove 27 being disposed immediately around the proximal end of the flexible tubular portion 24.

A portion (that is, about a half) of the thick tubular portion 25 extending from the flexible tubular portion 24 has a straight peripheral surface 28 having an outer diameter that is smaller than the outer diameter of the main waterproof portion 14, but is larger than the outer diameter of the flexible tubular portion 24. A tapered surface 29 extends from the straight peripheral surface 28, and tapers toward the rear end into an outer diameter slightly smaller than the outer diameter of the wire 11. The inner peripheral surface of the thick tubular portion 25 extends from the inner peripheral surface of the flexible tubular portion 24, progressively increases in diameter toward a central portion thereof, and progressively decreases in diameter from the central portion toward a rear end thereof. Thus, the inner peripheral surface of the thick tubular portion 25 is curved along the length thereof, and the thick tubular portion 25 has a thick peripheral wall as a whole. The overall inner peripheral surface, defined by the flexible tubular portion 24 and the thick tubular portion 25, is such that when the wire 11 is passed therethrough, a gap 38 is formed between the inner peripheral surface and the wire 11 (see FIG. 6).

Figure 5:
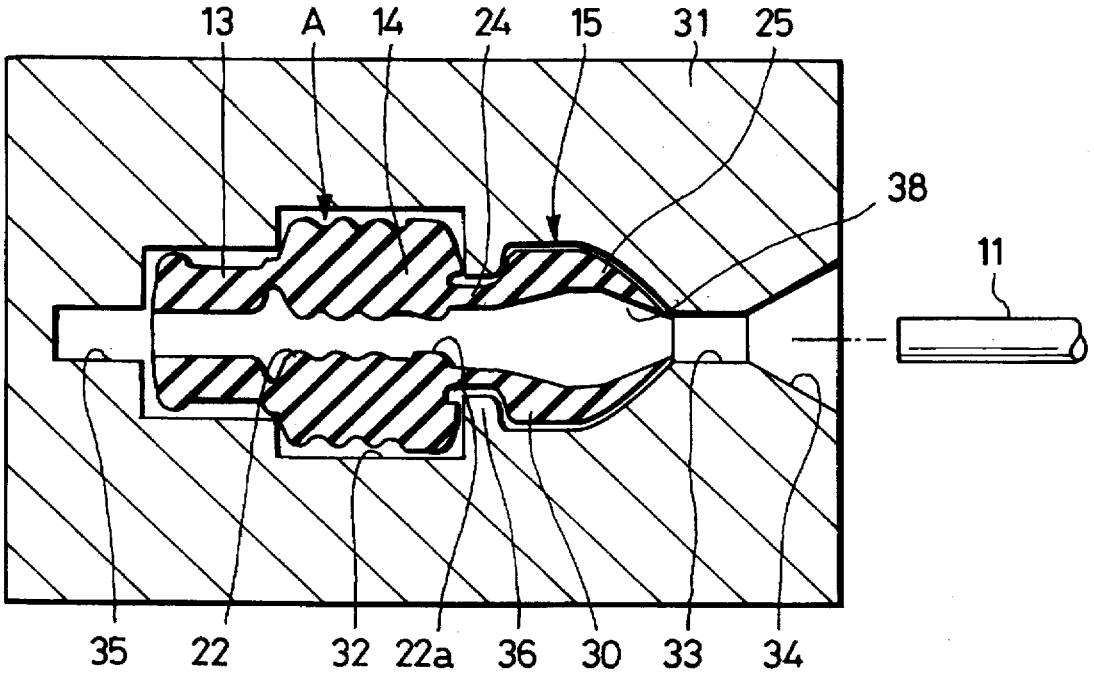
FIG. 5 is a cross-sectional view showing a process of inserting a wire.

FIG. 5 shows a jig 31 used for passing the wire 11 through the waterproof seal A. The jig 31 has assembly portions, and in its assembled condition the jig 31 has a receiving hole 32 therein for receiving the waterproof seal A against movement, the receiving hole 32 having a configuration generally conforming to the outer shape of the waterproof seal A. An insertion hole 33 is formed in that portion of the jig 31 disposed immediately adjacent to one end portion of the receiving hole 32 for receiving the thick tubular portion 25 of the waterproof seal A, and the insertion hole 33 is coaxial with the receiving hole 32 and open to an outer surface of the jig 31. A guide hole 34 flares from an inlet end of the insertion hole 33 to the outer surface of the jig 31. An outlet hole 35 is formed in the jig 31, and extends from the other end of the receiving hole 32 in coaxial relation thereto, the hole 35 having a closed inner end.

For passing the wire 11 through the waterproof seal A, the waterproof seal A is first received in the receiving hole 32 in the jig 31, as shown in FIG. 5. The front end portion of the wire 11 is inserted into the insertion hole 33 through the guide hole 34, and is further inserted into the bore of the thick tubular portion 25 of the waterproof seal A through the distal end thereof. Because the diameter of the distal end of the thick tubular portion 25 is smaller than the outer diameter of the wire 11, the front end of the inserted wire 11 abuts against the distal end of the thick tubular portion 25. However, a shoulder 30 of the thick tubular portion 25, disposed immediately adjacent to the flexible tubular portion 24, abuts against a projected portion 36 projecting into the receiving hole 32 in the jig 31, so that the thick tubular portion 25 can not be pushed inwardly. Moreover, the thick tubular portion 25 has the thick peripheral wall, and hence has a high buckling strength. Therefore, the wire 11 can be inserted into the bore of the wire embracing portion 15 although the distal end of the thick tubular portion 25 may be slightly turned inside.

At this time, because the gap 38 is formed between the inner periphery of the wire embracing portion 15 and the outer periphery of the wire 11, the wire 11 is smoothly inserted into the wire embracing portion 15 without receiving frictional resistance. When the wire 11 is further inserted, the wire 11 is passed through the main waterproof portion 14 while squeezing the inner lips **22*a* and 22. The wire is inserted into the outlet hole 35 through the mounting portion 13, and the front end of the wire 11 abuts against the inner end of the outlet hole 35 whereupon the insertion of the wire 11** is completed.

When the insertion of the wire 11 is thus completed, the waterproof seal A and the wire 1 are removed from the jig 31. The insulation barrel 42 of the metal terminal 41 is clamped to the outer periphery of the mounting portion 13 (having the bore in which the end portion of the sheath **11*a* of the wire 11 is fitted). A wire barrel 43 of the metal terminal 41 is clamped to an end portion of a conductor 11*b* extending from the end of the sheath 11*a* of the wire 11. Thus, the metal terminal 41 and the waterproof seal A are fixedly secured to the end portion of the wire 11**.

Figure 6:
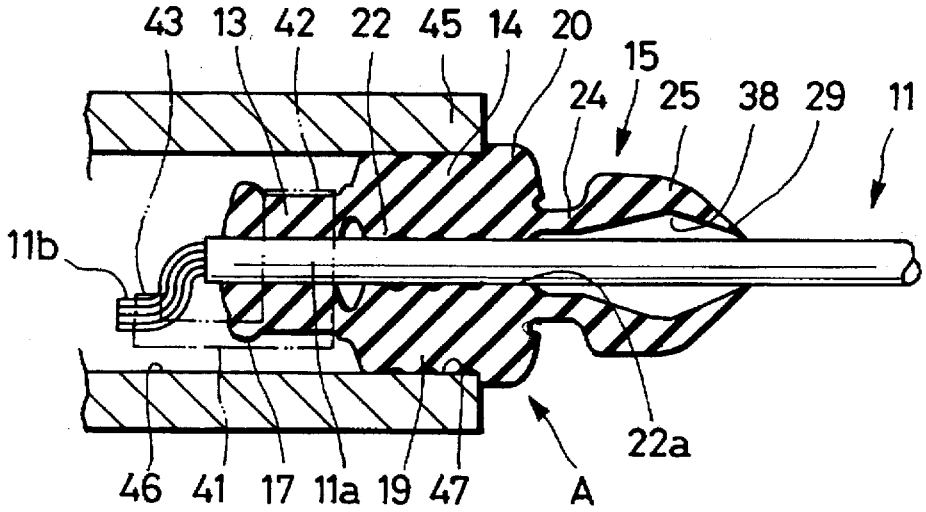
FIG. 6 is a cross-sectional view showing a condition in which a waterproof seal is mounted in a cavity in a connector housing.

The waterproof seal A, connected to the end portion of the wire 11, is inserted, together with the metal terminal 41, into the cavity 46 in the connector housing 45 through the insertion port 47, with the outer peripheral lips 19 of the main waterproof portion 14 being compressed. When the retaining portion 20 at the rear end of the main waterproof portion 14 abuts against the edge of the insertion port 47 of the cavity 46, the inserting operation is stopped, as shown in FIG. 6. At this time, a lance (not shown) provided within the cavity 46 retains the metal terminal 41 against withdrawal from the cavity 46.

When the waterproof seal A is thus mounted in the cavity 46, the wire embracing portion 15 is projected rearwardly of the cavity 46, and because of their resilient restoring force, the three outer peripheral lips 19 of the main waterproof portion 14 are held in intimate contact with the inner peripheral surface of the cavity 46, thereby forming a watertight seal between the outer periphery of the wire 11 and the inner periphery of the cavity 46. Also, because of their resilient restoring force, the four inner peripheral lips 22 and **22*a* of the main waterproof portion 14 are held in intimate contact with the outer periphery of the wire 11, and the distal end of the wire embracing portion 15 is held in intimate contact with the outer periphery of the wire 11, thereby forming a seal between the inner periphery of the waterproof seal A and the outer periphery of the wire 11**.

Figure 7:
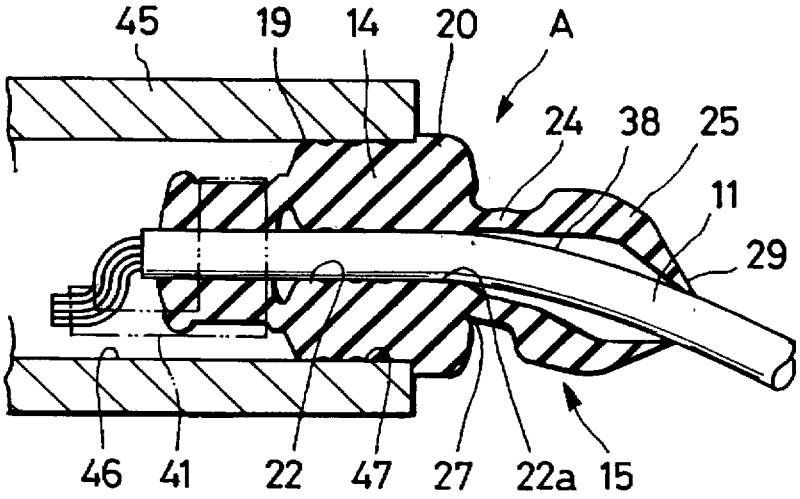
FIG. 7 is a cross-sectional view showing a condition in which a bending force acts on the wire.

Here, if the wire 11 projecting from the waterproof seal A is bent in a head-nodding manner as shown in FIG. 7, the flexible tubular portion 24 is bent or turned about the rearmost inner peripheral lip **22*a* in accordance with the movement of the wire 11 to close one side of the notch groove 27, with the rearmost inner peripheral lip 22*a* of the main waterproof portion 14 kept in intimate contact with the outer periphery of the wire 11. Because the inner peripheral lip 22*a* is wider than the other inner peripheral lips 22, this lip 22*a* is kept in intimate contact with the wire 11 even at the outer side of the bent portion of the wire 11**, thus keeping the sealing effect.

The flexible tubular portion 24 has the thin peripheral wall, and the gap 38 is formed between the inner periphery of the flexible tubular portion 24 and the wire 11. Further, the notch groove 27 is formed immediately around the proximal end of the flexible tubular portion 24. With this arrangement, the flexible tubular portion 24 can be quite easily bent. Therefore, the influence of the bending deformation of the flexible tubular portion 24 is hardly transmitted to the main waterproof portion 14, and a bending force does not significantly affect that end portion of the main waterproof portion 14 connected to the flexible tubular portion 24 at the inner side of the bent portion. Therefore an end portion is hardly subjected to deformation due to compression. Therefore, a tension, directed toward the axis of the main waterproof portion 14, is absorbed and will not act on an end portion of the main waterproof portion 14 connected to the flexible tubular portion 24 at the outer side of the bent portion. Therefore, the retaining portion 20 will not be disengaged from the edge of the insertion port 47 of the cavity 46. Also, the outer peripheral lips 19 will not move out of contact with the inner periphery of the cavity 46. As a result, a positive seal is secured between the main waterproof portion 14 and the cavity 46.

Because the inner peripheral lip **22*a*, serving as a fulcrum of the bending of the wire embracing portion 15, is provided on the main waterproof portion 14, and is disposed adjacent to the proximal end of the flexible tubular portion 24, the flexible tubular portion 24 is bent at the proximal end thereof. Therefore, the span of bending of the wire embracing portion 15 is long, that is, the wire embracing portion 15 is bent with a large radius of curvature over the entire length thereof, thus serving to suppress the transmission of the bending force to the main waterproof portion 14. If the wire embracing portion 15 is bent midway of the length thereof, the bending space is short, and the wire embracing portion 15 is bent with a small radius of curvature. In such a case, it is possible that at least part of the distal end of the wire embracing portion 15 moves out of contact with the wire 11, thus forming a gap therebetween. However, the wire embracing portion 15 is gradually bent with a large radius of curvature, and therefore the distal end of the thick tubular portion 25 is kept in intimate contact with the outer periphery of the wire 11**.

Moreover, the distal end portion of the thick tubular portion 25 of the wire embracing portion 15 has the tapered surface 29, and therefore when water under high pressure is applied to the wire embracing portion 15 from the distal end thereof during high-pressure cleaning, the water flows to the outer periphery of the wire embracing portion 15 along the tapered surface 29. Therefore, the applied water will not intrude into the area of contact between the inner periphery of the distal end of the thick tubular portion 25 and the outer periphery of the wire 11, and hence will not intrude into the waterproof seal.

As described above, in the waterproof seal A of this embodiment, the following various advantages are achieved. First, the wire embracing portion 15 has the thick tubular portion 25 of a high buckling strength extending to the distal end thereof over a predetermined length, and therefore the wire 11 can be passed through the waterproof seal A in the jig 31 without buckling the wire embracing portion 15. Moreover, the gap 38 is formed between the wire embracing portion 15, including the flexible tubular portion 24 and the thick tubular portion 25, and the wire 11 over its entire length so as to reduce frictional resistance, so that the insertion of the wire 11 can be effected quite easily.

When the wire 11 is to be inserted while holding the waterproof seal A by the hand, insertion can be carried out smoothly without causing buckling by holding the shoulder 30 by hand.

When a bending force acts on the wire 11 after the waterproof seal A mounted on the wire 11 is inserted into the cavity 46 in the connector housing 45, the flexible tubular portion 24 is easily bent about the inner peripheral lip **22*a* (which is disposed adjacent to the proximal end of the wire embracing portion 15) in accordance with the movement of the wire 11, thereby preventing the bending force from acting on the main waterproof portion 14, thus preventing the deformation of the main waterproof portion 14. As a result, the waterproof effect between the main waterproof portion 14 and the cavity 46 is enhanced. Moreover, the wire embracing portion 15 is bent over a long span, that is, substantially over its entire length, so that the bending angle is kept to a small angle. Therefore, the distal end of the thick tubular portion 25 maintains contact with the outer periphery of the wire 11**.

Furthermore, when water is applied to the distal end of the wire embracing portion 15 during high-pressure cleaning, the water flows to the outer periphery along the tapered surface 29 formed on the distal end portion of the thick tubular portion 25. Therefore, the water is prevented from intruding into the area of contact between the inner periphery of the distal end of the thick tubular portion 25 and the outer periphery of the wire 11, thus preventing the water from intruding into the waterproof seal.

The present invention is not to be limited to the above embodiment described above and shown in the drawings, and for example the following fall within the scope of the present invention. In addition to the following, various modifications can be made without departing from the scope of the invention.

Although the tapered surface 29 formed on the outer periphery of the distal end portion of the thick tubular portion 25 is tapered straight along the length thereof, the tapered surface may be tapered in a curved manner along its length, and such a tapered surface is also encompassed by the tapered surface defined in the invention.

In the waterproof seal, the retaining portion 20 having a large diameter is formed at the end of the main waterproof portion 14, and the retaining portion 20 is retained by the edge of the insertion port 47 of the cavity 46; however, the invention can be applied to the type of waterproof seal in which the entire main waterproof portion 14 is inserted into the cavity 46.

Figure 8:
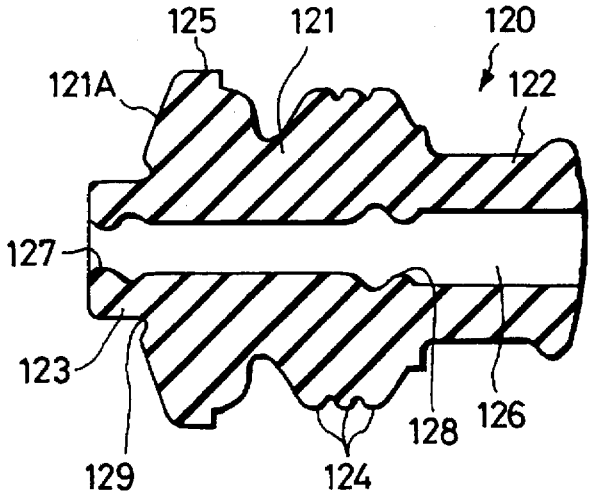
FIG. 8 is a cross-sectional view of a second preferred embodiment of the present invention.
Figure 9:
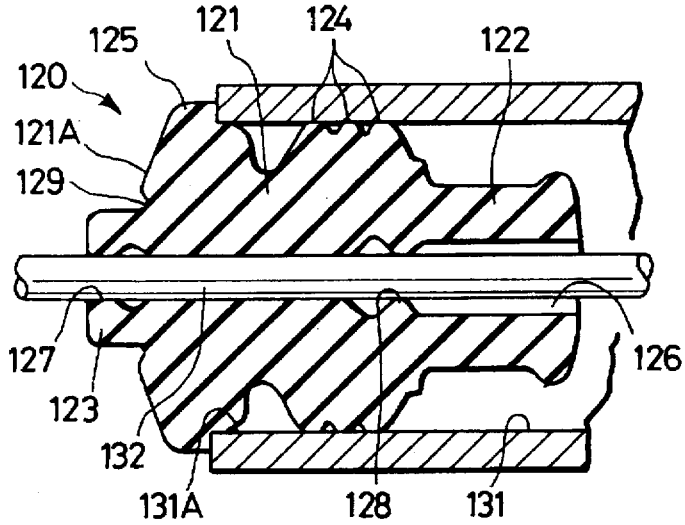
FIG. 9 is a cross-sectional view showing a condition in which a rubber plug of the second preferred embodiment is mounted in a cavity.

A second embodiment of the present invention will now be described with reference to FIGS. 8 and 9. Although some different terminology may be used, some of the components of the second embodiment are comparable to the components of the first embodiment.

A rubber plug 120 has an integrally-molded construction and includes a rubber plug body 121, a clamping portion 122 extending from one end of the rubber plug body 121, and a tubular portion 123 extending from the other end (surface) 121A of the rubber plug body 121.

Three peripheral lips 124 for intimate contact with an inner periphery of a cavity 131 (described later) are formed on an outer peripheral surface of a portion of the rubber plug body 121 disposed adjacent to the clamping portion 122. A larger-diameter portion 125 for closing an open end 131A of the cavity 131 is formed on an outer peripheral surface of a portion of the rubber plug body 121 disposed adjacent to the tubular portion 123.

A bore of the rubber plug 120, serving as a wire insertion hole 126, is open at one end to the distal end of the clamping portion 122, and also is open at the other end to the distal end of the tubular portion 123. Lips 127 and 128 intimately contact an outer periphery of a wire 132 and are formed on the inner peripheral surface of the wire insertion hole 126. The lip 127 is disposed adjacent to the distal end of the tubular portion 123 while the lip 128 is disposed adjacent to the clamping portion 122.

The wire 132 is passed through the wire insertion hole 126, and a barrel of a metal terminal (not shown) is compressively clamped to the clamping portion 122, so that the rubber plug 120 is integrally connected to the metal terminal and the wire 132. The rubber plug 120 in this condition is inserted into the cavity 131.

When the rubber plug is mounted in the cavity 131, the lips 124 on the outer periphery of the rubber plug body 121 are elastically deformed, and are held in watertight contact with the inner peripheral surface of the cavity 131. Also, the larger-diameter portion 125 is held in watertight contact with the edge of the cavity open end 131A and the inner periphery of the cavity 131, thus closing the open end 131A, as shown in FIG. 9.

The lips 127 and 128 on the inner peripheral surface of the wire insertion hole 126 in the rubber plug 120 are elastically deformed, and are held in watertight contact with the outer periphery of the wire 132. With this arrangement, water can not pass through the area of contact between the outer periphery of the rubber plug 120 and the inner periphery of the cavity 131, and also water can not pass through the area of contact between the inner periphery of the rubber plug 120 and the outer periphery of the wire 132. Therefore, water is prevented from intruding from the exterior into the inner side of the cavity 131 where the metal terminal is received.

The tubular portion 123 of the rubber plug 120 projects from the end surface 121A of the rubber plug body 121 that is disposed adjacent to the cavity open end 131A when the rubber plug 120 is fitted in the cavity 131. The tubular portion 123 is smaller in outer diameter than the rubber plug body 121, and therefore can be bent and deformed more easily than the rubber plug body 121.

An annular groove 129 is formed in the end surface 121A (on which the tubular portion 123 is formed), and is disposed immediately around the outer periphery of the proximal end of the tubular portion 123. The groove 129 has an arcuate transverse cross-section, and an inner peripheral edge portion of the groove 129 is smoothly continuous with the outer peripheral surface of the proximal end of the tubular portion 123.

When a bending force acts on that portion of the wire 132 extending from the tubular portion 123, the wire 132 is bent and deformed, and in accordance with this deformation, the tubular portion 123 is also elastically bent and deformed, so that the bending force is alleviated from the sealing portion and absorbed by an elastic restoring force of the tubular portion 123.

Figure 10:
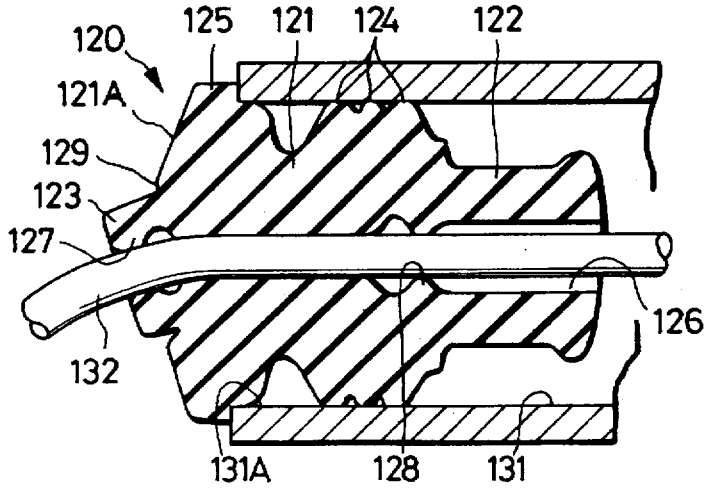
FIG. 10 is a cross-sectional view showing a condition in which a wire is bent in the second preferred embodiment.

Although a tension is applied from the tubular portion 123 to the rubber plug body 121 at an outer side of the bent portion, that surface of the rubber plug 120 defining the groove 129 is elastically deformed in a manner to widen this groove 129, thereby alleviating and absorbing this tension, as shown in FIG. 10. Therefore, the tension does not significantly affect the rubber plug body 121, and the larger-diameter portion 125 and the lips 124 of the rubber plug body 121 will not move out of contact with the inner peripheral surface of the cavity 131, thereby keeping a watertight seal between the rubber plug body 121 and the cavity 131.

When the wire 132 is bent, the tubular portion 123 is elastically bent and deformed in unison with the wire 132, and therefore a gap will not develop between the wire 132 and the inner periphery of the tubular portion 123 at the outer side of the bent portion. The lip 127 is formed on the inner periphery of the tubular portion 123, and firmly grips the wire 132. This also prevents a gap from developing between the tubular portion 123 and the wire 132.

At the inner side of the bent portion, the rubber plug body 121 and the tubular portion 123 are merely compressed by the wire 132, and therefore a gap between the rubber plug body 121 and the cavity 131, as well as a gap between the tubular portion 123 and the wire 132, will not develop.

Thus, by the use of the rubber plug 120 of this embodiment, a waterproof seal between the rubber plug 120 and the cavity 131, as well as a waterproof seal between the rubber plug 120 and the wire 132, is maintained even if a bending force acts on the wire 132, thereby positively preventing water from intruding into the cavity 131.

In this embodiment, the groove 129 is smoothly continuous with the outer peripheral surface of the proximal end of the tubular portion 123, and therefore when the wire 132 is bent at this portion, stresses produced by the tension from the tubular portion 123 are not locally concentrated, but are distributed. Therefore, breakage of the tubular portion 123 from the rubber plug body 121 due to local concentration of the stresses is prevented.

In this embodiment, the end surface 121A of the rubber plug 120 disposed outwardly of the cavity 131 projects and tapers toward its distal end, and the larger-diameter portion 125 closes the open end 131A of the cavity 131 from the outside. Therefore, even when the connector is mounted with the open end 131A of the cavity 131 directed upwardly, water outside the cavity 131 flows toward the outer periphery of the rubber plug along the tapering end surface 121A, and is guided to areas disposed radially outwardly of the open end 131A of the cavity 131, thereby positively preventing the water from intruding into the cavity 131.

The present invention is not to be limited to the embodiment described above and shown in the drawings, and for example the following embodiments fall within the scope of the invention, and further other various modifications than the following embodiments can be made without departing from the scope of the invention.

Although the groove 129 has the arcuate transverse cross-section, the groove 129 may have any other suitable cross-sectional shape.

In the above embodiment, although the groove 129 is smoothly continuous with the outer periphery of the proximal end of the tubular portion 123, the groove 129 may not be smoothly continuous with the outer periphery of the proximal end of the tubular portion 123.

In the above embodiment, although the larger-diameter portion 125 for closing the open end 131A of the cavity 131 is formed on the rubber plug body 121, the present invention can be applied to the type of rubber plug without such a larger-diameter portion.

What is claimed is:

1. A waterproof seal for sealing a cavity of a connector, comprising:

a main waterproof portion having an outer periphery contactable with an inner peripheral surface of the cavity; and a wire embracing portion formed integrally with and extending from said main waterproof portion, said wire embracing portion shaped to embrace at least two axially spaced portions of an outer periphery of a wire, said wire embracing portion including a flexible tubular portion having a reduced thickness extending from said main waterproof portion and a thickened tubular portion extending from a distal end of said flexible tubular portion, said thickened tubular portion being bulged radially outwardly over a predetermined length to define a closed gap substantially between said two axially spaced portions.

2. A waterproof seal for a connector according to claim 1, further comprising a tapered surface formed on an outer periphery of said thickened tubular portion, said tapered surface being tapered toward a distal end of said wire embracing portion.

3. A waterproof seal for a connector according to claim 1, further comprising a lip formed adjacent a boundary between said main waterproof portion and said wire embracing portion, said lip being securable in intimate contact with said wire, wherein, when said wire is inserted in said waterproof seal, a gap is formed between an inner periphery of said flexible tubular portion of said wire embracing portion and said wire.

4. A rubber plug for a waterproof connector comprising:

a rubber plug body having a tubular construction for passing a wire therethrough, said rubber plug body being adapted to be held in intimate contact with an inner periphery of a cavity of a connector;

a tubular portion extending from one end surface of said rubber plug body; and an annular groove axially formed in said end surface of said rubber plug body, said annular groove being disposed around an outer periphery of a proximal end connected to the rubber plug body of said tubular portion.

5. A rubber plug for a waterproof connector according to claim 4, wherein said annular groove includes a curved surface that is smoothly continuous with an outer periphery of the proximal end of said tubular portion.

6. A method for forming a waterproof seal comprising:

forming a main waterproof portion;

forming a wire embracing portion extending from said main waterproof portion; and providing at least one of said wire embracing portion and said main waterproof portion with means for absorbing bending forces applied to said waterproof seal including an annular groove disposed in an axial direction in said main waterproof portion, said annular groove being disposed around an outer periphery of a proximal end connected to said main waterproof portion of said wire embracing portion.

7. A method according to claim 6, further comprising:

providing said wire embracing portion with a reduced thickness portion, said reduced thickness portion being flexible and located adjacent said main waterproof portion; and dimensioning an inner surface of the reduced portion such that the inner surface is spaced from a wire inserted in the waterproof seal.

8. A method according to claim 7, further comprising:

providing a thickened tubular portion to the reduced tubular portion; and bulging the thickened tubular portion radially outwardly over a predetermined length such that the thickened tubular portion includes one portion that contacts the wire and a second portion that does not contact the wire.

9. A method according to claim 8, further comprising providing a tapered surface formed on an outer periphery of said thickened tubular portion, said tapered surface being tapered toward a distal end of said wire embracing portion.

10. A method according to claim 6, further comprising:

forming a lip adjacent a boundary between said main waterproof portion and said wire embracing portion, said lip being held in intimate contact with said wire; and forming a gap between an inner periphery of said flexible tubular portion of said wire embracing portion and a wire inserted in the waterproof seal.

11. A method according to claim 6, further comprising providing said main waterproof portion with said means for absorbing, wherein an annular groove is formed in said main waterproof portion, said annular groove being disposed around an outer periphery of a proximal end of said wire embracing portion.

12. A waterproof seal for sealing a cavity of a connector, comprising:

a main waterproof portion contactable with an inner peripheral surface of the cavity;

a wire embracing portion extending from said main waterproof portion and contactable with an outer periphery of a wire; and means for absorbing bending forces applied to said waterproof seal including an annular groove axially disposed and formed in a surface of said main waterproof portion, said annular groove being disposed around an outer periphery of a proximal end connected to the main waterproof portion of said wire embracing portion.

13. A waterproof seal according to claim 12, further comprising a reduced thickness portion in said wire embracing portion, said reduced thickness portion being flexible and located adjacent said main waterproof portion, wherein, when said wire is inserted in said waterproof seal, a gap is formed between an inner surface of the reduced portion and the outer perphery of the wire.

14. A waterproof seal according to claim 13, further comprising a thickened tubular portion formed on the reduced tubular portion, said thickened tubular portion bulging radially outwardly over a predetermined length such that the thickened tubular portion includes one portion contactable with the wire and a second portion that is not contactable with the wire.

15. A waterproof seal according to claim 14, further comprising a tapered surface formed on an outer periphery of said thickened tubular portion, said tapered surface being tapered toward a distal end of said wire embracing portion.

16. A waterproof seal according to claim 12, further comprising a lip formed adjacent a boundary between said main waterproof portion and said wire embracing portion, said lip being securable in intimate contact with said wire, wherein, when said wire is inserted in the waterproof seal, a gap is formed between an inner periphery of said flexible tubular portion of said wire embracing portion and said wire.

17. A method for forming a waterproof seal for sealing a cavity of a connector, said method comprising:

placing an outer periphery of a main waterproof portion in contact with an inner peripheral surface of the cavity;

embracing an outer periphery of a wire along at least two axially spaced positions with a wire embracing portion extending from said main waterproof portion;

providing at least one of said wire embracing portion and said main waterproof portion with means for absorbing bending forces applied to said waterproof seal, said means for absorbing including a thickened tubular portion bulged radially outwardly over a predetermined length and reduced thickness at an end portion of the thickened tubular portion to define a closed gap substantially between said two axially spaced portions.

18. A method according to claim 17, further comprising providing an annular groove in said main waterproof portion disposed around an outer periphery of a proximal end of said wire embracing portion.

* * * * *